United States Patent [19]

Lostutter

[11] 4,090,612

[45] May 23, 1978

[54] METHOD AND APPARATUS FOR TINTING CAULK

[75] Inventor: Rollie Lostutter, 4340 Poplar Creek Rd., Vandalia, Ohio 45377

[73] Assignee: Rollie Lostutter, Vandalia, Ohio

[21] Appl. No.: 756,784

[22] Filed: Jan. 5, 1977

[51] Int. Cl.[2] ..... B01F 15/00

[52] U.S. Cl. ..... 211/13; 211/60 R; 211/71; 366/92; 366/214

[58] Field of Search ..... 211/13, 60 R, 71; 206/446; 248/108, 109; 259/56, 54, 75

[56] References Cited

U.S. PATENT DOCUMENTS

| | | | |
|---|---|---|---|
| 966,729 | 8/1910 | Bradley | 211/60 R |
| 2,060,932 | 11/1936 | Friermood | 259/56 |
| 2,756,719 | 7/1956 | Peskek et al. | 211/13 X |
| 3,265,366 | 8/1966 | Warner | 259/56 |

*Primary Examiner*—Roy D. Frazier
*Assistant Examiner*—Robert W. Gibson, Jr.
*Attorney, Agent, or Firm*—Biebel, French & Nauman

[57] ABSTRACT

An apparatus for tinting caulk which has been prepackaged in cylindrical caulking tubes having a removable piston in one end of the tube and a fixed nozzle extending from the opposite end. The apparatus being securable in a reciprocating mixer of the type used for mixing paint. The apparatus has a generally cylindrical face member with a plurality of flanges extending perpendicular from the base member and each engageable with the bottom end of a caulking tube to position the tube perpendicular to the base member. A top member is provided with a plurality of holes defined therein through which the nozzles on the top end of the caulking tubes will extend and which are positionable in registry with the flanges on the base member so as to hold the caulking tubes from both the top and the bottom. A plurality of pivotal rods extend from the base member to the top member and are securable to the top member to hold the top member rigid relative to the bottom member and maintain the caulking tubes in position. The pistons in the bottom of the caulking tubes are removable and a predetermined amount of tint of the proper color can be placed in each tube and the piston replaced. The caulking tubes can then be mounted in the apparatus and placed on a reciprocating paint mixer or the like to cause thorough mixing of the tint with the caulking to produce the desired color of caulking compound.

3 Claims, 5 Drawing Figures

METHOD AND APPARATUS FOR TINTING CAULK

BACKGROUND OF THE INVENTION

1. Field of the Invention

The present invention relates to caulking compound tinting apparatus and methods, and more particularly to a method and means for tinting the caulking compound which has been prepackaged in relatively small quantities.

2. Prior Art

Caulking compounds are generally used to caulk joints where a waterproof seal is needed in the joint and which can be subsequently painted if necessary. Most caulking compounds are generally white or off-white tending toward a gray color which is the natural color of most caulking compounds, although some limited quantities of black or special order quantities of colors are available. The colored compounds, i.e. those other than white, cannot generally be commercially obtained except in very large quantities upon special order from the manufacturer. The reasons for this is that there is not a great deal of a demand for large quantities of particular colors of colored caulking compounds and is therefore impractical for a caulking compound manufacturer to produce large quantities of tinted caulking compounds having various colors and shades.

Therefore, such tinted caulking compound are generally not available for small users such as home owners and smaller comercial construction companies whose volume of use is not sufficient to warrant special orders of a particular tinted color of caulking compound. There is a desire, however, on the part of the purchasing public to have caulking compounds of various colors, such as those which would simulate wood tones. There is presently no economical means available of supplying this needed product since manufacturers of the caulking compounds cannot maintain sufficient variety of inventory or small quantities of caulking compound to suit the consumer needs.

SUMMARY OF THE INVENTION

The present invention solves the problems of the prior art by providing a method and means of tinting small quantities of caulking compounds which have been prepackaged by the manufacturer in the containers in which they are generally sold.

Caulking compound is readily available to the consuming public in prepackaged form in relatively small quantities in which the packages are generally cylindrical and have a nozzle extending from one end and a piston member inserted in the opposite end which can be pushed towards the nozzle end by application of pressure to the outside of the piston by use of conventional apparatus commonly referred to as caulking guns. The present invention contemplates the tinting of caulking compound packaged in this form. The procedure and apparatus of the present invention are sufficiently simple and inexpensive enough that a retail seller can provide whatever color a customer desires in only one or in as many tubes as the customer needs.

This is accomplished by providing a generally circular base member which has a plurality of cylindrical flanges extending upward perpendicular to the base member and defining cylindrical openings for matingly receiving the piston end of one of the caulking tubes, a circular top member disposable in spaced parallel relation above the base member and having a plurality of openings defined therein one of each of which is in registry with each of the cylindrical flanges on the base member, for mating engagement with the nozzles extending from caulking tubes supported on the flanges, and means for securing the top member to the bottom member to hold the caulking tubes in position in engagement with the top and base members. This assembly is so constructed that it can be easily secured in commercially available paint mixing equipment of the reciprocating type such as that disclosed in Warner U.S. Pat. No. 3,265,366, wherein it can be agitated sufficiently to cause the tint to mix with the caulking compound, thus providing the desired color of caulking compound.

Present day caulking compounds come in a variety of consistencies depending upon base material and additives utilized to produce the compounds, therefore some variations in the method of tinting the caulking compounds in the individual prepackaged tubes is necessary. In those caulking compound of relatively thin consistencies in which the tinting dye or pigment will sufficiently disperse through the caulking tube during agitation, no additional treatment is necessary. However, where the caulking compound is of such a thick consistency that the tinting dye or pigment will not uniformly penetrate the entire amount of compound contained in the caulking tube, at least without an agitating for inordinate length of time, a heating step prior to agitation is necessary.

In those cases where a heating step is necessary it may be done prior to placing the tint in the tube or immediately thereafter, so long as the time prior to agitation of the tubes is sufficiently short that the viscosity of the compound remains sufficiently low that the tinting dye or pigment will substantially uniformly color the entire quantity of compound within the tube.

DETAILED DESCRIPTION OF THE PREFERRED EMBODIMENTS

Figure 1:
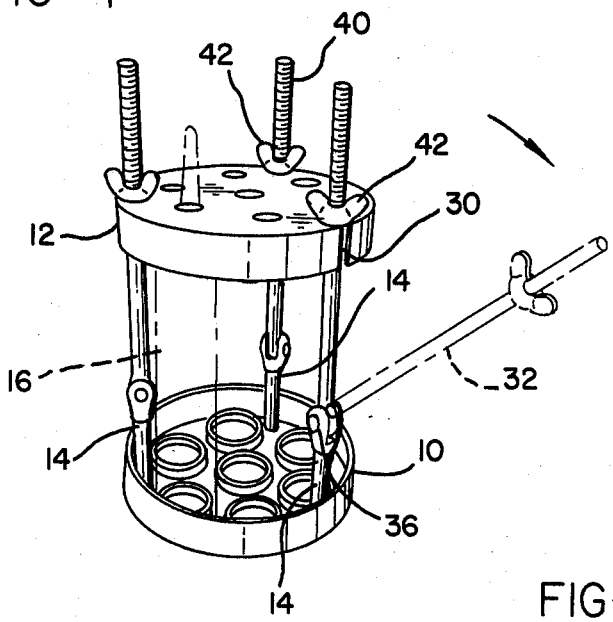
FIG. 1 is a perspective view of the preferred embodiment of the present invention.

The preferred embodiment of the present invention as best seen in FIG. 1, is generally comprised of a base member 10, a top member 12 and a plurality of securing members 14 which hold the top member rigid relative to the base member in the manner described below. A plurality of caulking tubes 16 are shown in phantom in the position in which they would be in during agitation of the caulking compound.

Figure 2:
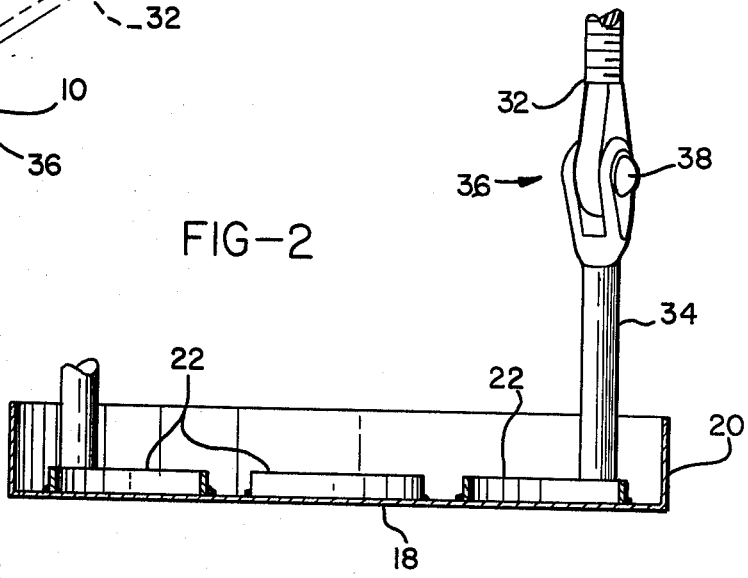
FIG. 2 is a cross sectional elevational view through the center line of the base member of the embodiment of FIG. 1.

The base member 10 is generally cylindrical and is constructed from a circular steel base plate 18 and a cylindrical steel band 20 weled or otherwise secured to the periphery of the base plate 18 as best seen in FIG. 2. A plurality of cylindrical flanges 22 are also welded or otherwise secured to the circular base plate 18. Flanges 22 have an outside diameter slightly less than the inside diameter of the wall of the piston in the base of caulking tubes 16 so that caulking tubes positioned on each of the flanges will be maintained perpendicular to the base plate 18 and prevented from substantial lateral movement relatve thereto.

In the preferred embodiment, six circular flanges 22 are secured to the base plate 18 at equal radial distances from the center and at equally spaced arcuate positions about the base plate. In addition, a seventh flange 22 is secured to the base plate 18 concentric with the center thereof. This arrangement permits as many as seven caulking tubes 16 to be secured in the apparatus at one time. Naturally, depending upon the size of the apparatus more or less flanges may be secure to the base plate for treating more or less caulking tubes at any one time.

Figure 3:
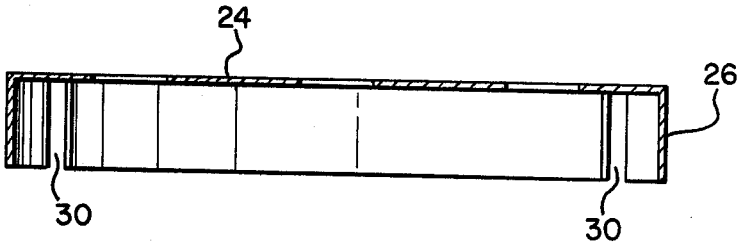
FIG. 3 is a cross sectional elevational view through the center line of the top member of the embodiment of FIG. 1.

The top member 12, as best seen in FIG. 3, is constructed in a manner similar to base member 10 in that a circular steel plate 24 is provided with a cylindrical steel band 26 welded thereto as seen in FIG. 3. A plurality of holes 28 are stamped or drilled into the circular plate 24 at locations which will be in registry with each of the circular flanges 22, for receiving the nozzle portion of the caulking tubes 16 when one is positioned over the flange 22.

A plurality of slots 30 are formed in the outer periphery of the top member at equal angularly spaced locations for receiving the upper portion of the securing members 14. Slots 30 extend radially inward towards the center of the top member 12 a sufficient distance to permit the securing members to be disposed substantially parallel to one another and perpendicular to the top member 12 and base member 10.

The securing members 14 of the preferred embodiment comprise upper and lower rod members 32 and 34 respectively, which are pivotally connected at 36 by pin 38 for pivotal movement in a radial plane extending through the center of both the base member 10 and top member 12. Each of the lower rods 34 is welded or otherwise secured to the base plate 18, as seen in FIG. 2, at the peripheral edge portions thereof, and extending perpendicular to the base plate at equal angular locations around the periphery of the base plate. Slots 30 are formed in the top member 12 at the locations in registry with the position of the securing member 14.

Each of the upper rods 32 has a threaded portion 40 upon which a wing nut 42 is disposed. The threaded portion 40 is sufficiently long to permit the top member 12 to be secured in engagement with the top surfaces of the caulking tubes 16 by tightening the wing nut 42 in engagement with the upper surface of plate 24 as seen in FIG. 1.

Figure 4:
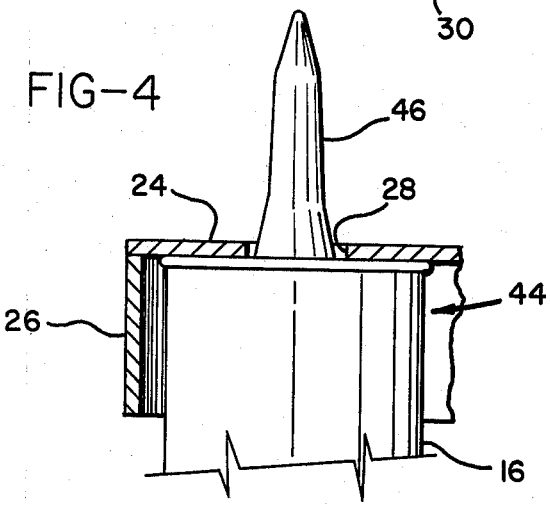
FIG. 4 is a fragmentary cross sectional view of the top member with a caulking tube in position.
Figure 5:
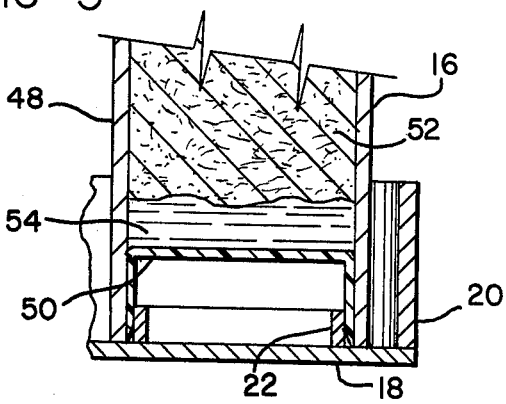
FIG. 5 is a fragmentary cross sectional view of the base member with a caulking tube in position.

When the preferred embodiment is assembled with the caulking tubes 16 in place, the caulking tubes will be secured at each end as shown in FIGS. 4 and 5. The upper end 44 of caulking tube 16 has a nozzle 46 which passes through the hole 28 with some clearance available. The circular plate 24 has its lower surface in engagement with the upper surface of the caulking tube 16 which holds the caulking tube in position.

As seen in FIG. 5, the bottom portion 48 of a conventional caulking tube 16 has a recessed piston 50 mounted therein in frictional engagement with the inside of the caulking tube 16 to maintain the caulking compound 52 within the tube and to expell it through the nozzle 46 in a conventional manner. When the tinting dye or pigment 54 has been placed within the bottom portion 48 of the caulking tube 16 and the piston 50 is replaced, the end portion 48 is then mounted on the circular flange 22 and is thus held in position relative to the base member 10 during mixing of the caulking compound 52 and tinting dye or pigment 54.

Referring now to the method in which the caulking compound 52 and tinting die or pigment 54 are mixed together in accordance with the present invention, it is to be understood that in accordance with the present invention it is anticipated that the caulking compound will be in a prepackaged form of conventionally available caulking tubes 16 which usually contain less than 12 oz. of caulking compound. The tint or pigment used to color the caulking compounds is essentially the same as that used to tint paints. For example, there is a tint referred to in the trade as an all phase tint which can be used to tint both oil base and Latex types of paint.

A variety of caulking compounds are currently available in this prepackaged form, and depending upon the intended use of the compound, the viscosity can vary greatly. With some of the lower viscosity caulking compounds the tint will migrate through the entire tube when agitated and be disseminated uniformly, thus uniformly tinting the compound.

In higher viscosity caulking compound, however, the tinting dye or pigment cannot reasonably be disseminated evenly through the caulking compound by agitation, at least within a reasonable period of time. In the latter case, it is therefore necessary to heat the caulking compound to reduce its viscosity sufficiently to permit the tinting dye or pigment to be evenly disseminated throughout the caulking compound to provide the uniform color desired.

For example, with the Latex type of caulking compounds it has been discovered that if the tubes are heated so that the temperature of the caulking compound is in the range of 130°–150° F, these compounds will have a sufficiently low viscosity to allow the tinting dye to thoroughly mix with and uniformly color the caulking compounds. Obviously, depending upon the particularly caulking compound being tinted, the temperature range will vary, however, the necessary temperature range can be established by simple trial and error.

In any event, the generally procedure for tinting the caulking compound in the preprepared packages of caulking tubes is to first remove the piston 50, and if there is not sufficient volume in the tube to permit the addition of tinting material and replacement of the piston, a portion of the compound must be removed prior to inserting the tint. The piston is then placed in its original position and the tubes are mounted on the base members 10 on top of each of the circular flanges 22 as shown in FIG. 5. The top member 12 is then placed on the top of the caulking tubes with the nozzles 46 extending through the holes 28. The securing members 14 are then pivoted into position in the slots 30 and wing nuts 42 are tightened down onto the top surface of the top member so that the bottom surface of the circular plate 24 compressively engages the top surface of the caulking tubes 16.

This assembly is then placed in a reciprocating paint shaking and mixing apparatus of the type commonly available, such as that disclosed in Warner U.S. Pat. No. 3,265,366. The apparatus is then shaken for five to ten minutes in order to thoroughly mix the tint with the caulking compound.

As mentioned above, in those cases where the viscosity of the caulking compound is too high to permit the tint to disseminate through the compound within a reasonable period of time while agitating, it is necessary prior to the agitation step to heat the tubes in an oven to a temperature sufficient to lower the viscosity to a point where the tint will disseminate uniformly through the compound.

Although the foregoing description illustrates the preferred embodiment of the present invention, other variations are possible. All such variations as would be obvious to one skilled in this art are intended to be included within the scope of the invention as defined by the following claims.

What is claimed is:

1. A caulk tinting apparatus for use in tinting caulk which has been prepackaged in cylindrical caulking tubes having a removable piston in one end of the tube and a fixed nozzle extending from an opposite end the apparatus being securable in a reciprocating mixer of the type used for mixing paint and the like, the apparatus comprising:

a base member having a plurality of spaced cylindrical flanges disposed perpendicular to the base members each flange matingly receiving said one end of one of said caulking tubes;

a top member disposed in spaced parallel relation to said base member and having a plurality of openings defined therein one each in registry with each of said flanges for mating engagement with the fixed nozzles extending from each said caulk tube; and means removably securing said top member to said bottom member with said caulk tubes engaged in said flanges and openings.

2. A caulk tinting apparatus as defined in claim 1 wherein said base member and said top member are generally cylindrical and a plurality of said flanges are arranged in equally arcuately spaced positions on a circular path concentric with said cylindrical base member and a further of said flanges is disposed concentric with said base member.

3. A caulk tinting apparatus as defined in claim 2 wherein said securing means includes a plurality of equally arcuately spaced threaded rods disposed about an outer peripheral edge portion of said base member and pivotally secured thereto, receiving slots defined in said top member in registry with each said rod for receivably engaging said rods, and threaded nuts on each said rod rigidly securing said top member relative to said base member with a plurality of said tubes mounted in said apparatus.

* * * * *

UNITED STATES PATENT AND TRADEMARK OFFICE

CERTIFICATE OF CORRECTION

PATENT NO. : 4,090,612

DATED : May 23, 1978

INVENTOR(S) : Rollie Losutter

It is certified that error appears in the above-identified patent and that said Letters Patent are hereby corrected as shown below:

Column 1, line 18, "toward" should be --towards--.

Column 1, line 32, "comercial" should be --commercial--.

Column 2, line 22, "compound" should be --compounds--.

Column 3, line 16, "secure" should be --secured--.

Column 4, line 25, "compound" should be --compounds--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*